US005588237A

United States Patent [19]

Chase et al.

[11] Patent Number: 5,588,237

[45] Date of Patent: Dec. 31, 1996

[54] SYSTEM FOR MOUNTING BILLBOARDS

[76] Inventors: Jeffrey A. Chase, 1388 Keenan Way, San Jose, Calif. 95125; Joseph L. Chase, 1159 Chippewah Dr., Chattanooga, Tenn. 37412

[21] Appl. No.: 183,035

[22] Filed: Jan. 18, 1994

[51] Int. Cl.[6] ..... G09F 21/04

[52] U.S. Cl. ..... 40/597; 40/591; 248/205.8

[58] Field of Search ..... 40/597, 588, 589, 40/590, 591, 617, 624; 248/205.8, 205.9, 362, 205.6, 305, 306

[56] References Cited

U.S. PATENT DOCUMENTS 2,047,658 7/1936 Zaiger ..... 248/205.8

2,109,571 3/1938 Le Boeuf ..... 248/363 X 2,675,983 4/1954 King ..... 40/591 X

FOREIGN PATENT DOCUMENTS 383690 11/1932 United Kingdom ..... 248/205.8

*Primary Examiner*—Kenneth J. Dorner

*Assistant Examiner*—Cassandra Davis

*Attorney, Agent, or Firm*—Limbach & Limbach LLP

[57] ABSTRACT

A device for temporarily mounting a billboard to an exterior surface on a vehicle utilizes a rectangular frame for supporting the billboard and a pair of vacuum cups for attaching the frame to the side of the vehicle. The vacuum cups are provided with a pumping mechanism for creating a substantially leak-proof seal against the surface of the vehicle and for thus preventing unintended detachment of the sign from the surface.

4 Claims, 7 Drawing Sheets

SYSTEM FOR MOUNTING BILLBOARDS

FIELD OF THE INVENTION

The present invention relates to the field of attachment systems for billboards and particularly to systems for removably mounting billboards to the exterior surfaces of vehicles such as buses.

BACKGROUND OF THE INVENTION

Municipal buses are frequently equipped with mounting devices which enable advertising billboards to be displayed on their exterior surfaces. A mounting device of this type commonly includes a frame comprised of four members defining a rectangular region. The frame is typically bolted to the exterior surface of a bus. The billboard is positioned within the rectangular region and is held in place by the members lining its four sides.

Tour buses and other motor coaches which are not normally available for municipal use are typically not equipped with permanent devices for mounting and displaying signs. Buses of this type are often chartered by convention participants and other groups desiring to display their advertisements or affiliations on the sides of the coaches. An owner or operator of a bus of this type will normally prohibit the display of placards on the sides of the bus if the mounting device for the placards could mar the exterior surface of the bus.

To date, the only non-permanent means available for affixing signs to the exterior surfaces of buses is heavy tape such as duct tape. The adhesion provided by tape is not always sufficient to hold a heavy sign in place. Moreover, moisture, such as from rain or humidity, or dirt present on the surface of the bus will compromise the integrity of the bond and may cause the sign to prematurely fall off of the bus. The heavy adhesive tape will often leave a residue on the exterior of the bus that may be difficult to remove without the use of solvents which can damage the paint on the bus surface.

A mounting system is therefore needed which will allow temporary but secure mounting to the side of the bus and which will not damage the exterior surface of the bus.

OBJECT AND SUMMARY OF THE INVENTION

It is an object of the present invention to provide an apparatus for temporarily attaching a billboard or placard to the exterior surface of a vehicle. It is yet another object of the present invention to provide an apparatus for attaching a billboard or placard to the exterior surface of a vehicle without marring the exterior surface of the vehicle.

The present invention is comprised of a rectangular frame removably connected to one or more vacuum cups. The frame is configured for holding a billboard or sign. A pair of pads or bumpers may be attached to selected portions of the frame to prevent unintended movement of the frame which may damage the surface of the vehicle. The apparatus is temporarily fixed to the vehicle by pressing the vacuum cups against the exterior surface of the vehicle and removing air from the cups to create a seal between the cups and the exterior of the vehicle.

DETAILED DESCRIPTION OF THE INVENTION

Figure 1:
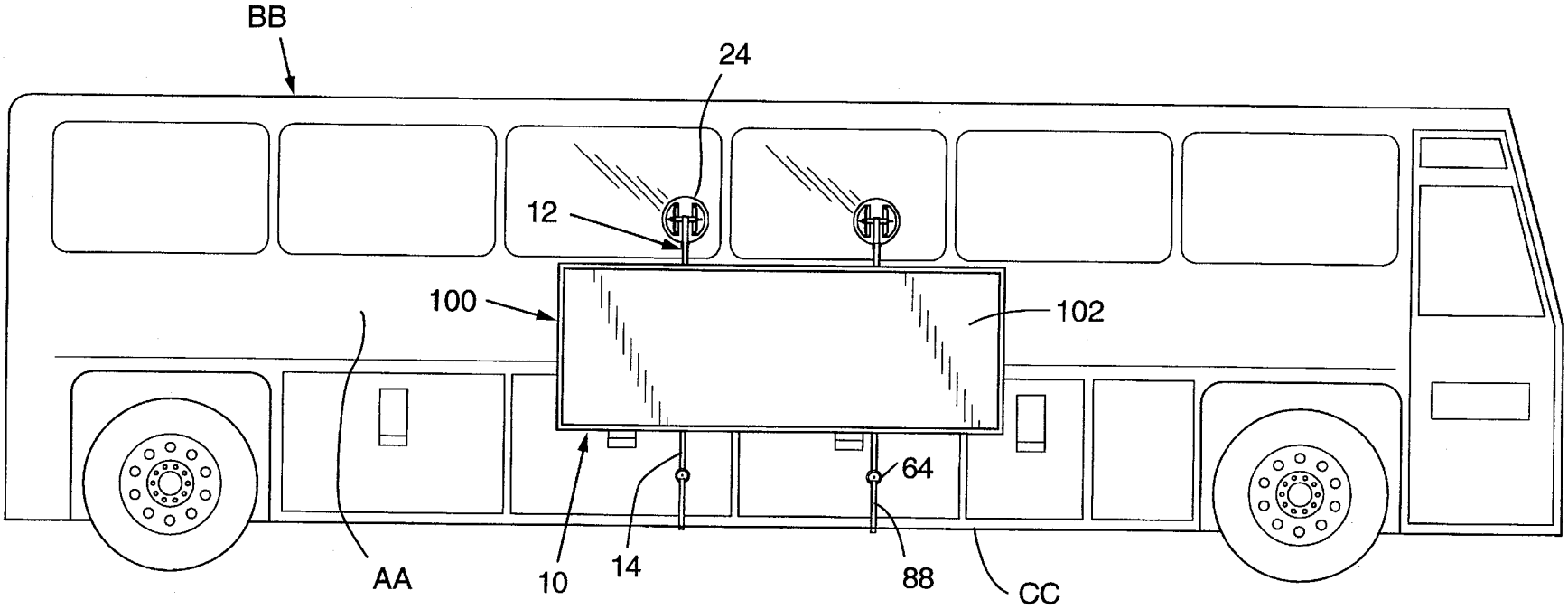
FIG. 1 is a front view of a billboard mounting assembly according to the present invention schematically showing the assembly and a billboard mounted to the side of a motor coach.

FIG. 1 shows a billboard mounting assembly 100 as used for attaching a billboard 102 to the side panel AA of a motor coach BB. The mounting assembly is comprised generally of a frame 10, a pair of upper support members 12 each having a vacuum cup 24, and a pair of lower support members 14.

Figure 3A:
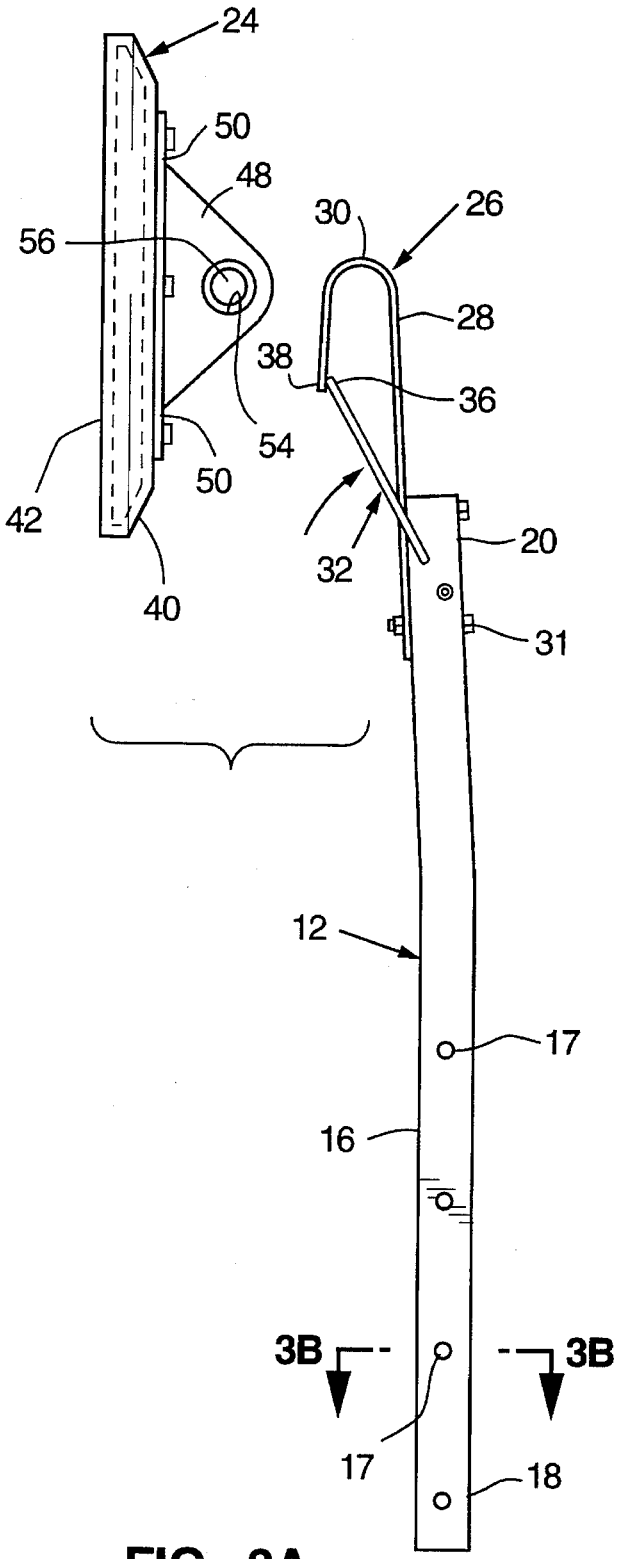
FIG. 3A is a side view of an upper support member of a billboard mounting assembly according to the present invention.
Figure 3B:
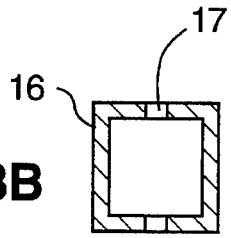
FIG. 3B is a cross-section view of an upper support member taken along the plane designated 3B—3B in FIG. 3A.
Figure 4:
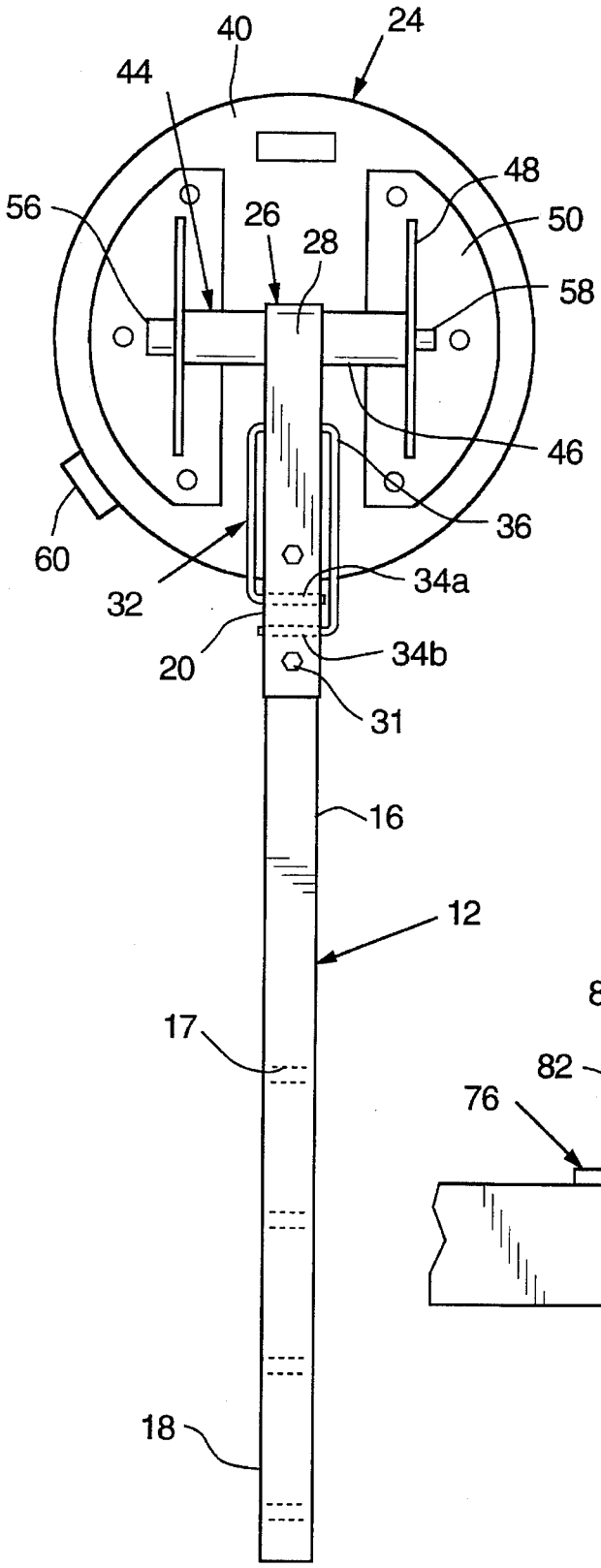
FIG. 4 is a front view of an upper support member of a billboard mounting assembly according to the present invention.

An upper support member 12 is shown in FIGS. 3A, 3B and 4. The upper support member 12 is comprised of an elongate member 16 having a first end portion and a second end portion, designated 18 and 20, respectively. The elongate member 16 is substantially square in cross-section and is angled slightly near the second end portion 20. A collection of bores 17 pass through the elongate member 16.

Each upper support member 12 is provided with a hooking device 26 for hooking the upper support members 12 to the vacuum cup 24. The hooking device 26 is comprised of a plate 28 formed into a hook 30 at one end and fastened by bolts 31 to the second end portion 20 of elongate member 16. A latch member 32 is comprised of an elongate loop having a pair of substantially parallel rods 34*a*, 34*b* at one end, each secured within a separate bore in the second end portion 20 of the elongate member 16. Another end 36 of the latch member 32 is positioned in abutting engagement with end 38 of the hook 30 as shown in FIG. 3A. The latch member 32 is preferably made from a slightly bendable but resilient material so that a force applied to the end 36 in the direction indicated by the arrow in FIG. 3A will cause end 36 to bend temporarily towards plate 28 to form a gap between ends 38 and 36.

Figure 7:
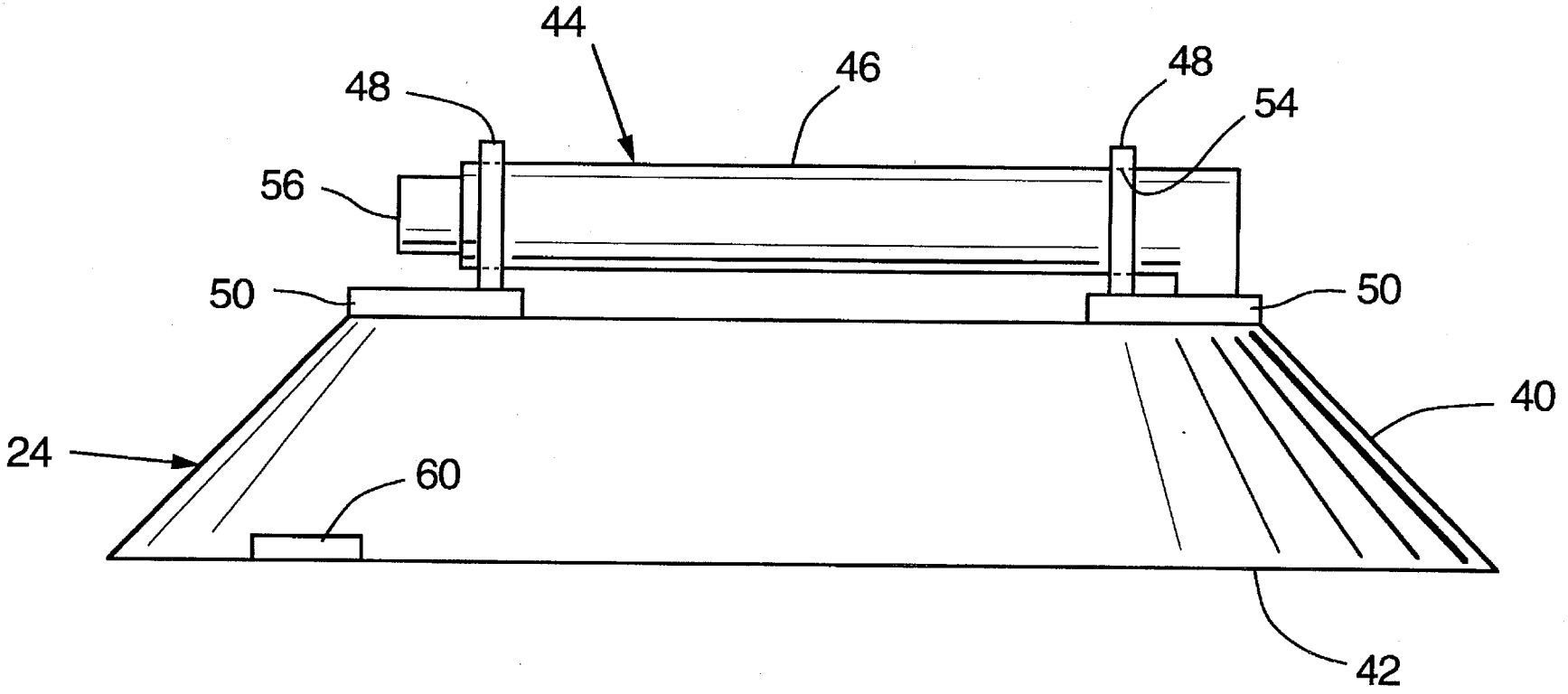
FIG. 7 is a side view of a preferred vacuum cup for use with the upper support members according to the present invention.

As can be seen in FIGS. 4 and 7, a preferred vacuum cup 24 for use with the present invention is a conventional gripping cup of the type normally used for carrying glass and heavy equipment. The vacuum cup comprises a rubber cup 40 having an open side 42 which, during use, is positioned against a mounting surface, such as a side panel of a motor coach. A hand pump 44 is supported by a pair of mounts 48. Each mount 48 extends normally of a plate 50 bolted to the rubber cup 40. As shown in FIG. 3A, each mount 48 has a hole 54 formed into it.

The hand pump 44 is comprised of a cylindrical shaft 46 which extends through the holes 54 in the mounts 48 to form a handle on the vacuum cup 24. A piston 56 is incorporated into one end of the cylindrical shaft 46, which has a passageway (not shown) into the interior region of the cup such that depression of the piston 56 causes air to be evacuated from the cup 24 and thus causes a seal to form between the cup and the mounting surface. The cup 24 includes a tab 60 which, when lifted, lifts a portion of the cup slightly from the mounting surface and thus allows air to enter the cup 24 and to thus break the seal.

Figure 8:
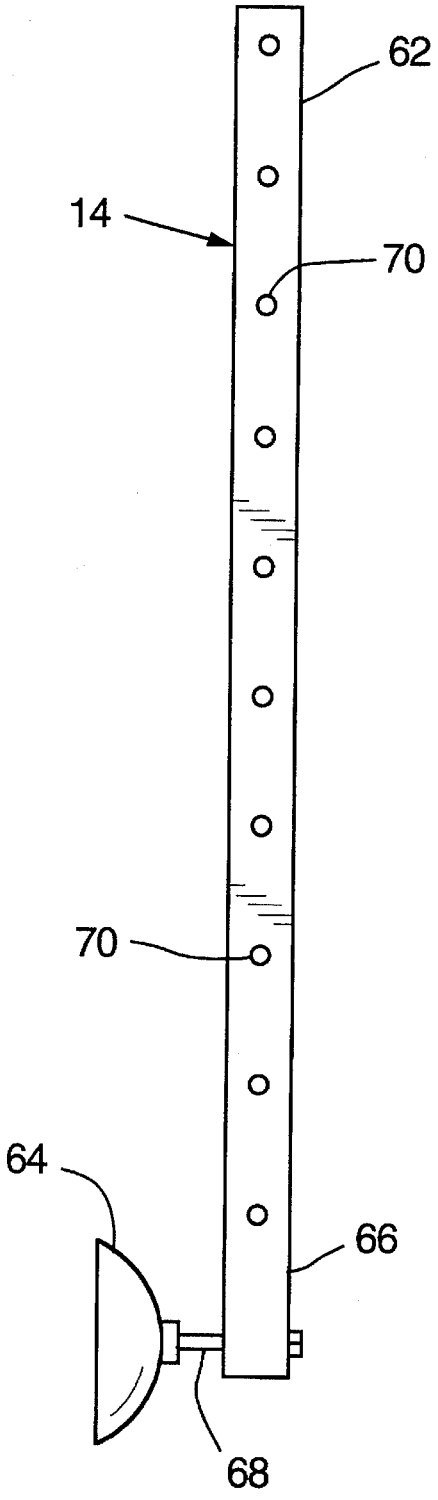
FIGS. 8 and 9 are a side view and a front view, respectively, of a lower support member of a billboard mounting assembly according to the present invention.
Figure 9:
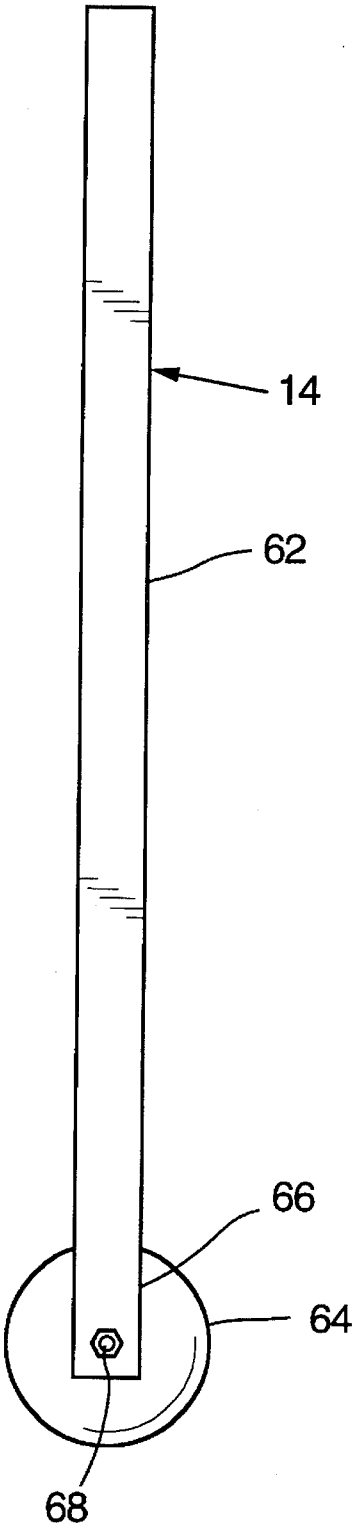

A lower support member 14 is shown in FIGS. 8 and 9. Each lower support member 14 is comprised of an elongate rod 62 having a substantially identical cross-section to that of the upper support member 12. A pad or bumper 64 is attached to an end 66 of the rod by a bolt 68 passing through the bumper and the rod. In the preferred embodiment, the bumper 64 is a suction cup that is smaller than the vacuum cups 24 used on the upper support members 12 and that provides a minimal amount of suction. A series of bores 70 pass through the rod 62 at a direction substantially perpendicular to that of the bolt 68.

Figure 2:
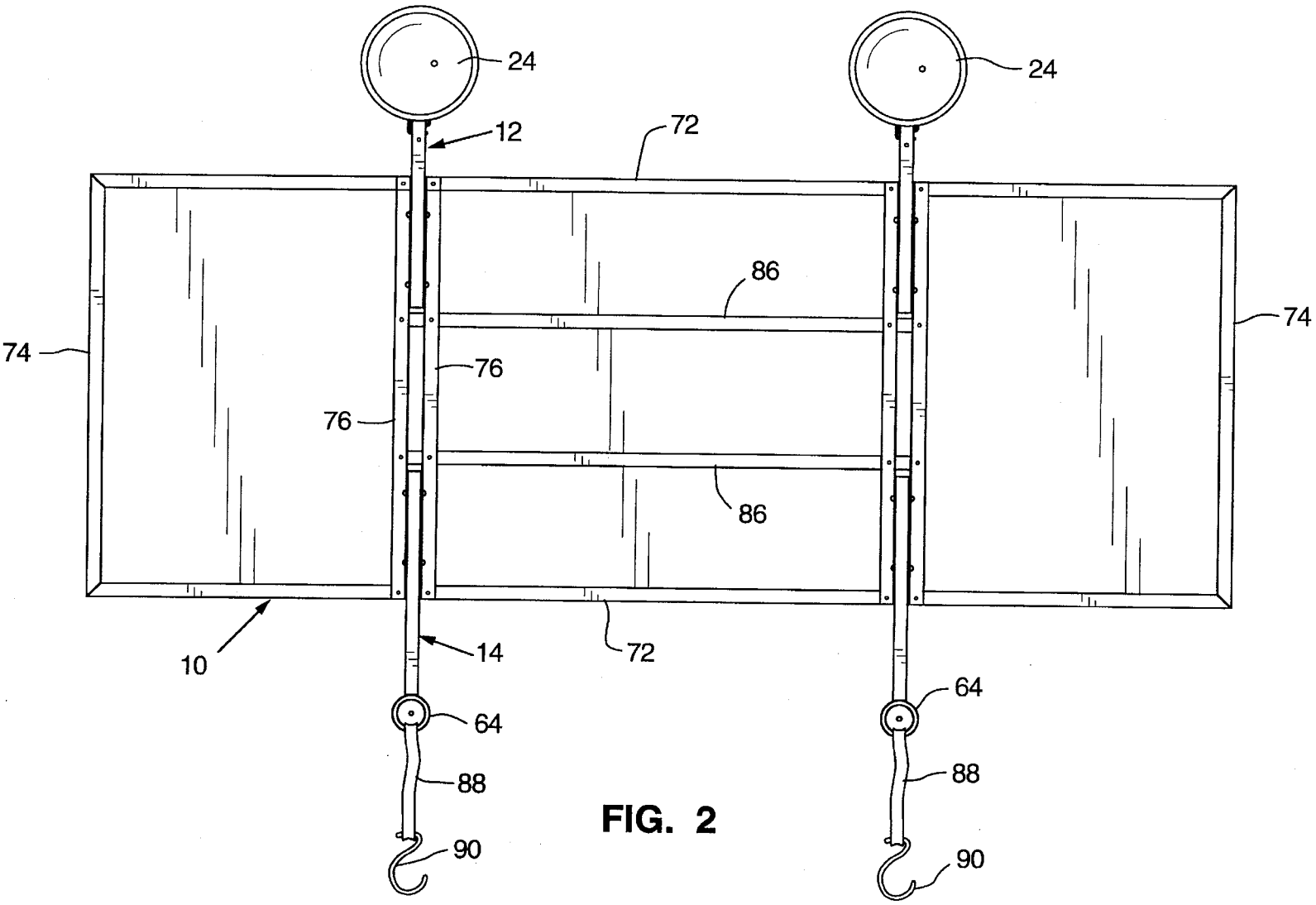
FIG. 2 is a rear view of a billboard mounting assembly according to the present invention.

Referring to FIG. 2, the frame 10 is rectangular in shape. It is formed from a pair of parallel elongate frame members 72 connected at their ends to a second pair of shorter parallel frame members 74. The frame members 72, 74 are constructed so as to support a billboard 102 by conventional means. To increase the rigidity of the frame, four cross-members 76 are bolted to the frame 10 parallel to frame members 74.

Figure 5:
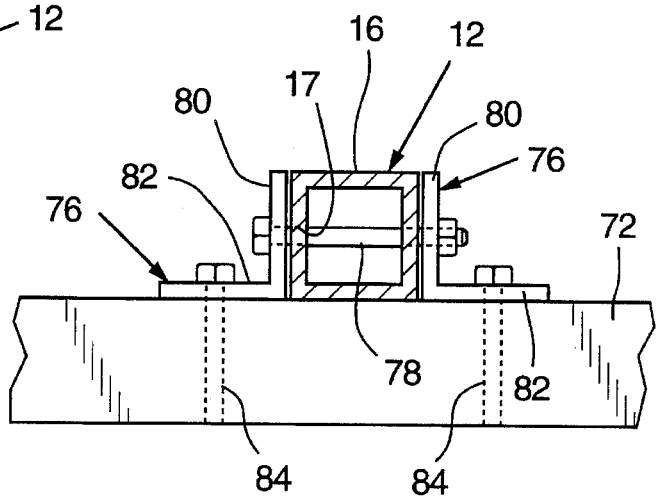
FIG. 5 is a partial top section view of the billboard mounting assembly showing an upper support member attached to the frame.
Figure 6:
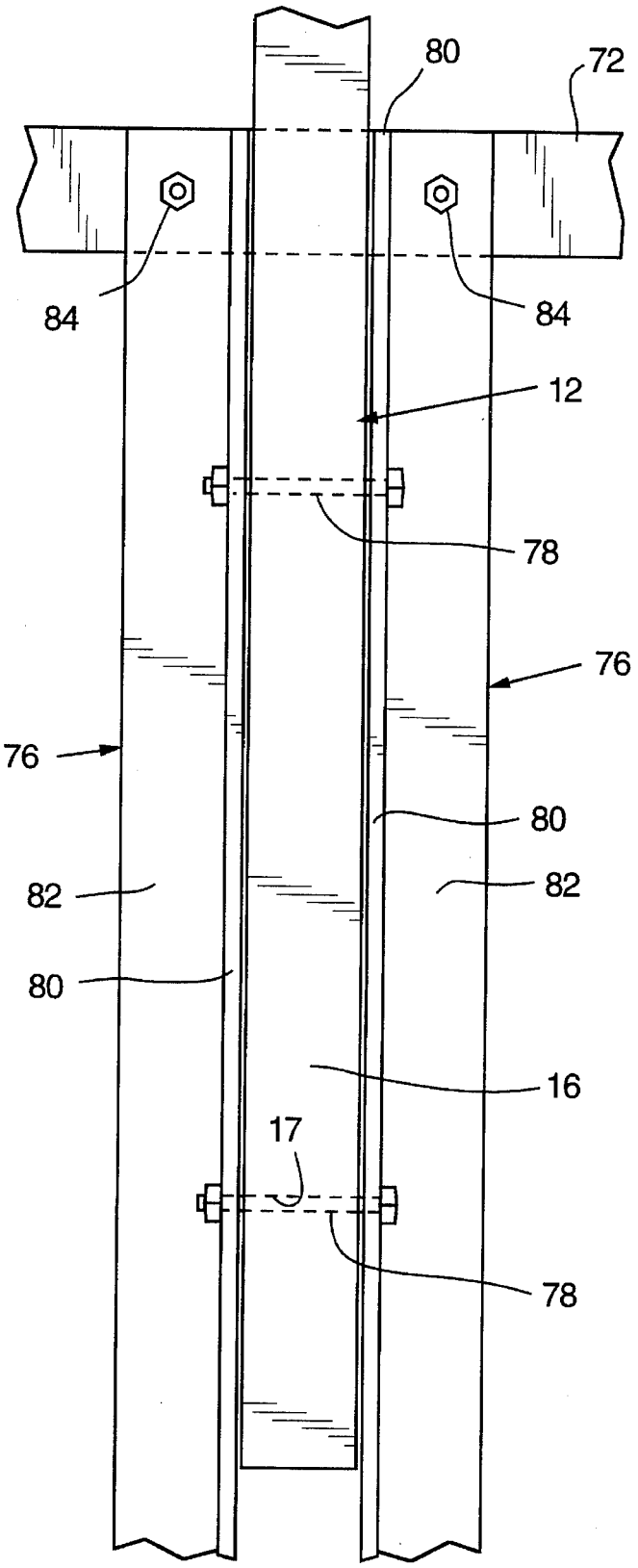
FIG. 6 is a partial rear view of the billboard mounting assembly showing an upper support member attached to the frame.

As shown in FIGS. 5 and 6, the cross-members 76 have an L-shaped cross-section comprising a first portion 80 and a second portion 82 perpendicular to the first portion. Each upper support member 12 is disposed between a pair of cross-members 76 and is connected to those cross-members by bolts 78 passing through the bores 17 in the elongate member 16 and further through the first portion 80 of each L-shaped cross-member 76. Second portions 82 of the L-shaped cross-members 76 are secured to frame members 72 by bolts 84. The lower elongate members 14 are secured to the frame in an identical manner.

The upper support members 12 and lower support members 14 are provided with numerous bores 17, 70 so that the support members 12, 14 may be extended a desired distance from the frame 10 so as to proportion the mounting system to be mounted on vehicles of differing sizes.

Additional reinforcing members 86 are positioned parallel to elongate frame members 72 and are bolted to cross-members 76 as shown in FIG. 2.

Attachment of the billboard mounting device of the present invention to a mounting surface such as the side panel AA (see FIG. 1) of a motor coach will next be described. The vacuum cups 24 are mounted to the mounting surface first, independently of the remainder of the apparatus. The open side 42 of each vacuum cup 24 is positioned at the desired location on the side panel of the motor coach. The vacuum cups 24 should be mounted such that the cylindrical shafts 46 of the hand! pumps 44 are substantially parallel to the horizontal plane. The pistons 56 of the hand pumps 44 are next repeatedly depressed to remove air from within the vacuum cups 24 and to thereby create a vacuum between the vacuum cups 24 and the side panel of the motor coach.

Once the vacuum cups 24 have been attached to the side panel AA, the frame 10 which will have a billboard positioned within it, is connected to them. To do this, the end 36 of the latch 32, which is connected to elongate member 16 as shown in FIGS. 3A and 4, is pressed against the cylindrical shaft 46 of the pump 44, causing the end 36 to deflect as described above to allow the ends 38 and 36 to pass around shaft 46 until hook 30 becomes disposed around the cylindrical shaft 46 of the pump 44. The end 36 then deflects back into abutting engagement with end 38 of the hook 30 to create a barrier against accidental separation of the elongate member 16 from the cylindrical shaft 46.

As shown in FIGS. 1 and 2, straps 88 may be connected to the elongate members 14 near the pads or bumpers 64 and fastened to the undercarriage CC of the motor coach using S-hooks 90 or other connecting means so as to secure the frame 10 against the side walls AA and to thereby prevent the frame 10 from pivoting around the vacuum cups 24 during travel of the motor coach.

We claim:

1. An apparatus for temporarily displaying a sign from an exterior surface of a vehicle, the apparatus comprising:

a frame configured for holding a sign, the frame including an upper portion and a generally rectangular portion configured for housing the sign;

a hook mounted to the upper portion of the frame;

a plurality of vacuum cups, each having an open end for positioning against the surface;

hook receiving means mounted to at least one of the cups for detachably engaging with the hook;

vacuum means for removing air from the vacuum cups when the open ends are positioned against the exterior surface of the vehicle to create a substantially airtight seal between the cups and the exterior surface of the vehicle; and stabilizing means for stabilizing a lower portion of the frame against the exterior surface of the vehicle;

and wherein the frame further comprises a plurality of upper support members extending from an upper portion of the rectangular portion, the upper support members detachably connected to the vacuum cups and adjustable to accommodate vehicles of varying sizes.

2. The apparatus of claim 1 wherein the frame further comprises a plurality of lower support members extending from a lower portion of the rectangular portion, wherein the lower support members are adjustable to accommodate vehicles of varying sizes and wherein the stabilizing means is connected to the lower support members.

3. An apparatus for temporarily displaying a sign from an exterior surface of a vehicle, the apparatus comprising:

a generally rectangular frame;

vacuum cups detachably mounted to an upper portion of the frame, the vacuum cups adapted for secure engagement with the exterior surface;

stabilizing means for stabilizing a lower portion of the frame against the exterior surface; and a plurality of upper support members extending from the upper portion of the frame, wherein the vacuum cups are detachably mounted to the upper support members and wherein the upper support members are selectively extendable from the frame by a plurality of predetermined distances to accommodate a variety of sized vehicles.

4. The apparatus of claim 3 further comprising a plurality of lower support members extending from the lower portion of the frame, wherein the stabilizing means are connected to the lower support members and wherein the lower support members are selectively extendable from the frame by a plurality of predetermined distances to accommodate a variety of sized vehicles.

* * * * *